US006776149B1

(12) United States Patent
Beeks

(10) Patent No.: US 6,776,149 B1
(45) Date of Patent: Aug. 17, 2004

(54) ARROW REST COUNTER WEIGHT

(76) Inventor: John R. Beeks, 226 Hickory Knoll Dr., Bluffton, IN (US) 46714

( * ) Notice: Subject to any disclaimer, the term of this patent is extended or adjusted under 35 U.S.C. 154(b) by 0 days.

(21) Appl. No.: 10/620,599

(22) Filed: Jul. 17, 2003

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 4,421,092 A 12/1983 Christian
4,453,528 A * 6/1984 Eckert ..... 124/44.5
4,569,325 A 2/1986 Christian
5,365,912 A 11/1994 Pittman
5,526,800 A 6/1996 Christian
5,944,005 A 8/1999 Schiff
6,021,769 A 2/2000 Troncoso
6,082,348 A 7/2000 Savage
6,615,813 B1 * 9/2003 Troncoso et al. ..... 124/44.5

* cited by examiner

*Primary Examiner*—John A. Ricci
(74) *Attorney, Agent, or Firm*—Patent & Trademark Services, Inc.; Joseph H. McGlynn

(57) ABSTRACT

A conversion kit for an arrow rest having an elongated wire having two ends and a first loop between the first and second ends. Attached to the first end of the wire is a weight and the second end features a second loop. A connecting string attaches the first loop to a bus cable of an archery bow. The second loop is attached to an arrow rest which is attached to the archery bow. The conversion kit for an arrow rest allows the arrow rest to rotate faster so that the arrow rest does not interfere with an arrow when a user draws and releases the bus cable of the archery bow.

5 Claims, 2 Drawing Sheets

ARROW REST COUNTER WEIGHT

BACKGROUND OF THE INVENTION

This invention relates, in general, to a conversion kit for an arrow rest, and, in particular, to a conversion kit for an arrow rest having a counter weight.

DESCRIPTION OF THE PRIOR ART

In the prior art various types of drop away arrow rests have been proposed. For example, U.S. Pat. No. 5,944,005 to Schiff discloses an arrow rest that is moved horizontally away when the arrow is shot.

U.S. Pat. No. 5,365,912 to Pittman discloses a movable arrow rest, which uses a spring to move the rest.

U.S. Pat. No. 6,021,769 to Troncoso discloses a movable arrow rest, which uses a spring to move the rest.

U.S. Pat. No. 6,082,348 to Savage discloses a movable arrow rest, which uses a magnet to move the rest.

U.S. Pat. No. 5,526,800 to Christian discloses an adjustable arrow support assembly.

U.S. Pat. No. 4,421,092 to Christian discloses an adjustable arrow support assembly.

U.S. Pat. No. 4,569,325 to Christian discloses an adjustable arrow support assembly.

In contrast to these prior art references and the known prior art, the present invention provides a drop away arrow rest having a weight on one end that assists the arrow rest to drop faster.

SUMMARY

The present invention provides a a conversion kit for a drop away arrow rest having a weight on one end that assists the arrow rest to drop faster.

It is an object of the present invention to provide a new and improved a conversion kit for an arrow rest.

It is an object of the present invention to provide a new and improved a conversion kit for an arrow rest that does not interfere with the fletching of an arrow.

It is an object of the present invention to provide a new and improved a conversion kit for an arrow rest that increases arrow speed by eliminating the friction between the arrow and conventional arrow rests.

It is an object of the present invention to provide a new and improved a conversion kit for an arrow rest that secures the arrow in a deep cradle created by the fingers.

It is an object of the present invention to provide a new and improved a conversion kit for an arrow rest that is not in the line of fire.

It is an object of the present invention to provide a new and improved a conversion kit for an arrow rest that secures an arrow longer in the cradle during the draw cycle of the bow.

These and other objects and advantages of the present invention will be fully apparent from the following description, when taken in connection with the annexed drawings.

DESCRIPTION OF THE PREFERRED EMBODIMENT

Figure 1:
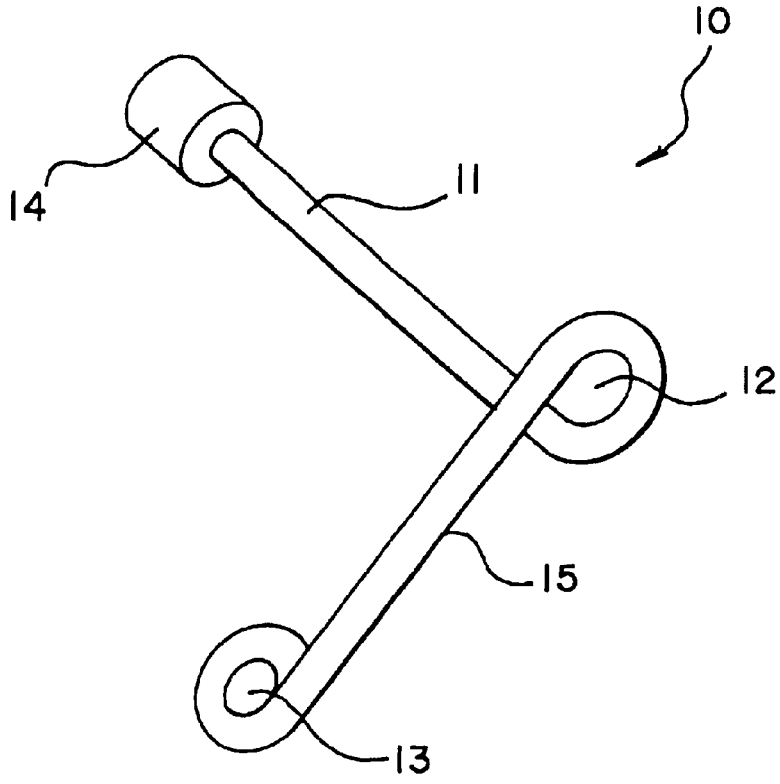
FIG. 1 is a perspective view of the present invention.

Referring to the drawings in greater detail, FIG. 1 shows the present invention 10 having wire 11, first loop 12, second loop 13 and counter weight 14. While FIG. 1 shows that the present invention 10 has a counter weight 14 that is substantially cylindrical in shape, and first loop 12 and second loop 13 are substantially rounded, one of ordinary skill would realize that the present invention 10 may be different sizes or shapes. For example, counter weight 14 may be other shapes such as, but not limited to, rectangular.

While the present invention 10 is described as having wire 11, one of ordinary skill would realize that the present invention 10 may be manufactured from various materials well known within the art such as, but not limited to, aluminum, steel, various metals, plastics, or the like, as long as the material is lightweight and retains its shape. The present invention 10 may be made in a variety of colors, shapes or sizes in order offer the user a plurality of choices. For example, the present invention 10 may be colored a bright orange which is a color commonly used by hunters.

The present invention 10 features a first element or wire 11 having a first end and a second end. A first loop 12 is formed on the second end of the wire 11 and the weight 14 is attached to the first end of the first element 11. A second element 15 is attached at one end to the second end of the first element 11. A loop 13 is formed in the second end of the second element 15. Loop 12 and loop 13 may be in different planes with respect to each other.

The first and second elements 11 and 15 form a predetermined angle with respect to each other, preferably, 90°. In other embodiments, the angle between the first and second second elements may change given a user's preferences.

Attached, by any means well known within the art, to the first end of first element 11 is counter weight 14 having a predetermined weight, preferably, six ounces. Counter weight 14 may be permanently attached to wire 11 or counter weight 14 may be releasably attached in order to allow the user to add different weights for the user's preference.

Figure 2:
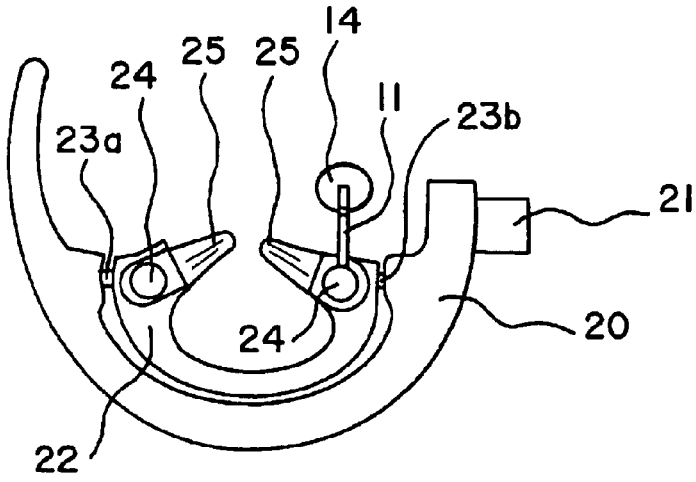
FIG. 2 is a view of the present invention attached to an arrow rest.

FIG. 2 is a view of the present invention attached to an arrow rest. The invention having wire 11, loop 12, loop 13 (not shown in FIG. 2), counter weight 14, housing 20, attachment device 21, pivot frame 22, pivot pins 23*a* , 23*b*, at least one screw 24 and at least one speed fin 25. The arrow rest, as shown in FIG. 2, substantially operates in a manner as described in U.S. Pat. No. 5,526,800 (Christian), which is hereby incorporated by reference.

The arrow rest, as shown in FIG. 2, attaches to a conventional archery bow, by any means well known within the art, such as by attachment device 21. In order to attach the present invention 10 to an arrow rest, at least one screw 24 is inserted through loop 13. Pivot frame 22 has at least one hole that is, preferably, threaded so that the screw 24 may threadedly attach to the pivot frame 22. Therefore, the screw 24 attaches the present invention 10 and at least one speed fin 25 to the arrow rest. While the screw 24 is used to attach the present invention 10 to the arrow rest, one of ordinary skill would realize that any means in the art may be used to attach the present invention 10 to the arrow rest. Additionally, the present invention 10 may be permanently attached to arrow rest.

Figure 3A:
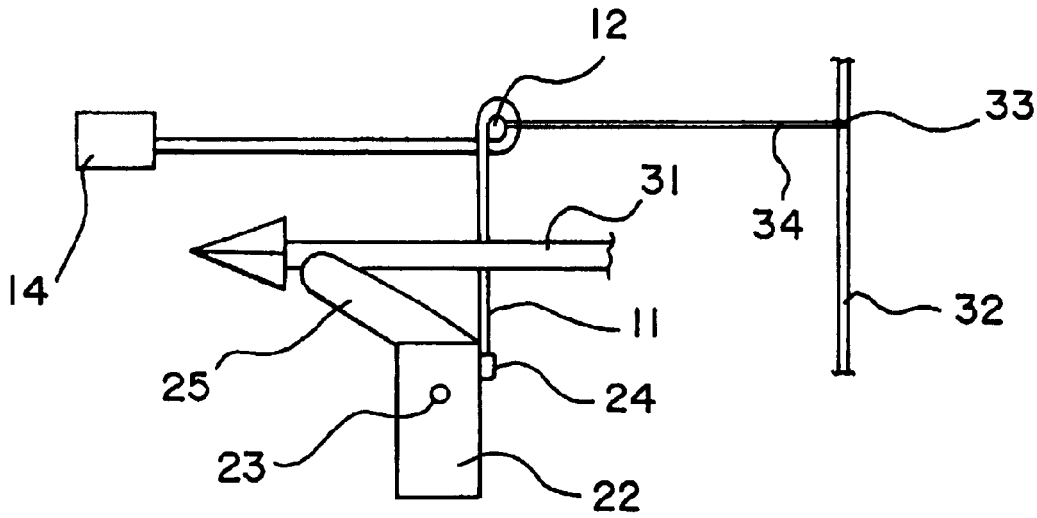
FIG. 3*a* is a side view of the present invention.

FIG. 3*a* shows a side view of the present invention 10 as it is attached to a conventional archery bow (not shown), as described above. It is to be appreciated that FIG. 3*a* describes the present invention 10 when the archery bow is substantially fully drawn and the user is about to release bus cable 32. FIG. 3*a* shows a conventional arrow 31 having two ends and an elongated shaft. Attached to the first end of the conventional arrow is a tip and attached to the second end of the conventional arrow 31 is at least one fletching (not shown).

A connecting string 34 is attached, by any means well known in the art, at one end to hole 12 and at the other end to bus cable 32 at point 33. The elongated shaft of the conventional arrow 31 is placed adjacent the speed fin 25.

When the bus cable 32 is substantially fully drawn, caused by the shooting string being fully drawn, the connecting string 34 is substantially taut and holds the weight 14 in the position shown in FIG. 3*a*. Since the connecting string 34 is taut and is connected to loop 12, this connection holds the pivot frame 22 in a substantially upright position, as shown in FIG. 3*a*.

Figure 3B:
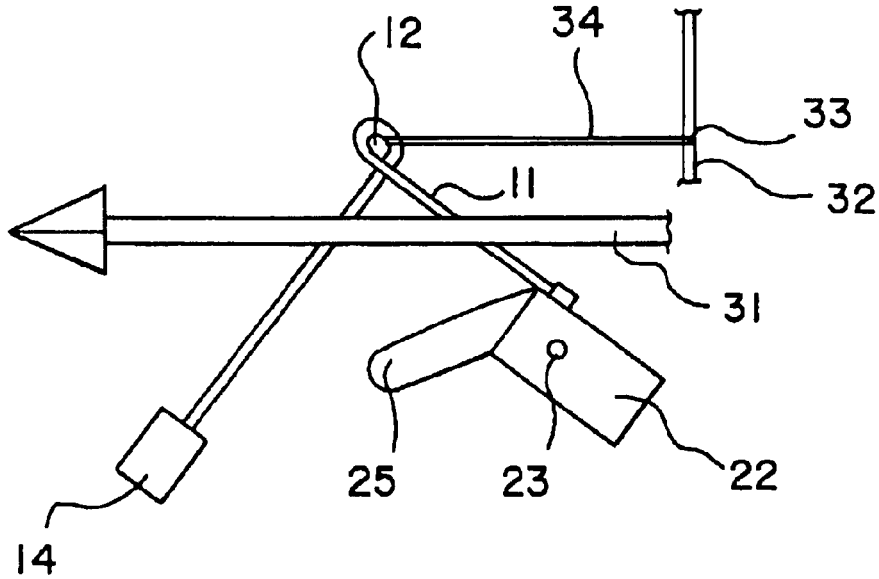
FIG. 3*b* is a side view of the present invention when the bus cable is released.

FIG. 3*b* shows the present invention just after bus string 32 has been released. This causes the conventional arrow 31 to start its forward movement. Additionally, forward movement of the string 32 allows the weight 14 to pivot downwardly as shown in FIG. 3*b*. The pivot frame 22 and the speed fin 25 start rotating downwards also, around pivot pin 23. Since counterweight 14, attached by wire 11, is offset with respect to pivot pin 23, counterweight 14 applies an increased downward force on the present invention allowing pivot frame 22 to rotate faster (than it would under normal effests of gravity) around the axis of pivot pin 23. Since the pivot frame 22 rotates faster due to the effects of counter weight 14, no part of the conventional arrow 31 will substantially interfere with the arrow rest causing the speed, accuracy and trajectory of the conventional arrow 31 to substantially increase.

Although the arrow rest counter weight and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim my invention is:

1. An attachment for an arrow rest attached to a bow, said attachment comprising:

a first element, said first element having a first end and a second end, said first end of said first element having a weight attached thereto, and said second end of said first element having means for securing said attachment to a bus cable of a bow, a second element, said second element having a first end attached to said second end of said first element, and said second element has a second end having means for attaching said second element to an arrow rest.

2. The attachment as claimed in claim 1, wherein said first and second elements are unitary.

3. The attachment as claimed in claim 1, wherein said means for securing said attachment to a bus cable of a bow is a loop formed in said first element.

4. The attachment as claimed in claim 1, wherein said means for attaching said second element to an arrow rest is a loop formed in said second element.

5. The attachment as claimed in claim 1, wherein said first and second elements form a substantially 90 degree angle.

* * * * *